US008727035B2

(12) United States Patent
Tollefsen et al.

(10) Patent No.: US 8,727,035 B2
(45) Date of Patent: May 20, 2014

(54) SYSTEM AND METHOD FOR MANAGING TEMPERATURE IN A WELLBORE

(75) Inventors: Edward M. Tollefsen, Katy, TX (US); Daniel Crowel, Bangkok (TH); Alexis S. Husser, Richmond, TX (US); Barbara J. A. Zielinska, Palaiseau (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 341 days.

(21) Appl. No.: 13/194,462

(22) Filed: Jul. 29, 2011

(65) Prior Publication Data

US 2012/0055672 A1 Mar. 8, 2012

Related U.S. Application Data

(60) Provisional application No. 61/370,868, filed on Aug. 5, 2010.

(51) Int. Cl.
*E21B 36/00* (2006.01)

(52) U.S. Cl.
USPC ..... 175/17; 175/61

(58) Field of Classification Search
USPC ..... 175/17, 61
See application file for complete search history.

(56) References Cited

U.S. PATENT DOCUMENTS

| | | | | |
|---|---|---|---|---|
| 3,807,502 | A | 4/1974 | Heilhecker et al. | |
| 3,957,118 | A | 5/1976 | Barry et al. | |
| 4,126,848 | A | 11/1978 | Denison | |
| 4,605,268 | A | 8/1986 | Meador | |
| 4,806,928 | A | 2/1989 | Veneruso | |
| 4,901,069 | A | 2/1990 | Veneruso | |
| 5,052,941 | A | 10/1991 | Hernandez-Marti et al. | |
| 5,278,550 | A | 1/1994 | Rhein-Knudsen et al. | |
| 5,531,592 | A | 7/1996 | Tasi | |
| 5,971,072 | A | 10/1999 | Huber et al. | |
| 6,641,434 | B2 | 11/2003 | Boyle et al. | |
| 6,866,306 | B2 | 3/2005 | Boyle et al. | |
| 7,246,940 | B2 * | 7/2007 | Storm et al. | 374/136 |
| 7,413,021 | B2 | 8/2008 | Madhavan et al. | |
| 7,806,191 | B2 | 10/2010 | Braden et al. | |
| 2008/0277162 | A1 * | 11/2008 | DiFoggio | 175/17 |
| 2008/0314638 | A1 * | 12/2008 | Kaul et al. | 175/17 |
| 2009/0166087 | A1 | 7/2009 | Braden et al. | |

FOREIGN PATENT DOCUMENTS

| | | | |
|---|---|---|---|
| EP | 399987 | A1 | 11/1990 |
| RU | 2040691 | C1 | 7/1995 |
| RU | 2140527 | C1 | 10/1999 |
| WO | 9014497 | A2 | 11/1990 |

OTHER PUBLICATIONS

McDonald, W. J., "Four Different Systems Used for MWD", The Oil and Gas Journal, vol. 76(14), 1978, 5 pages.

* cited by examiner

*Primary Examiner* — William P Neuder
(74) *Attorney, Agent, or Firm* — Mark D. Shelley, II; Kimberly Ballew

(57) ABSTRACT

A system and a method manage temperature in a wellbore. A thermal barrier may be positioned within the drill pipe and/or the drill collars to obtain a desired downhole temperature and/or control the effect of thermal energy in high-angle and horizontal wellbores. Downhole measurements, such as real-time measurements and/or recorded measurements, may be used to update models, such as steady state models and/or dynamic models. The downhole measurements may validate the static temperature gradient and may provide information about the thermal characteristics of the one or more formations in which the wellbore is located.

20 Claims, 5 Drawing Sheets

SYSTEM AND METHOD FOR MANAGING TEMPERATURE IN A WELLBORE

CROSS-REFERENCE TO RELATED APPLICATIONS

This application claims the benefit of U.S. Provisional Application Ser. No. 61/370,868 filed Aug. 5, 2010 the entirety of which is incorporated by reference.

FIELD OF THE INVENTION

The present disclosure generally relates to a system and a method for managing temperature in a wellbore. More specifically, the present disclosure relates to positioning thermally coated pipe joints to obtain a desired downhole temperature and/or control the effect of thermal energy in high-angle and horizontal wellbores.

BACKGROUND INFORMATION

To obtain hydrocarbons, a drilling tool is driven into the ground surface to create a wellbore through which the hydrocarbons are extracted. Typically, a drill string is suspended within the wellbore. The drill string has a drill bit at a lower end of the drill string, and the drill string extends from the surface to the drill bit. The drill string may be formed by drill pipes joined together, a coiled tubing string, casing joined together, and/or combinations thereof.

Wired drill pipe is a type of drill pipe which has a communication channel within each pipe joint. Early approaches to a wired drill string which use wired drill pipe to convey signals are disclosed in U.S. Pat. No. 4,126,848; U.S. Pat. No. 3,957,118; U.S. Pat. No. 3,807,502; and the publication "Four Different Systems Used for MWD," W. J. McDonald, The Oil and Gas Journal, pages 115-124, Apr. 3, 1978.

Use of inductive couplers to convey signals, such as inductive couplers located at the pipe joints, has also been proposed. The following disclose use of inductive couplers in a drill string: U.S. Pat. No. 4,605,268; Russian Federation published patent application 2140527, filed Dec. 18, 1997; Russian Federation published patent application 2040691, filed Feb. 14, 1992; and PCT Patent Application Publication WO 1990/14497. Also see U.S. Pat. No. 5,052,941; U.S. Pat. No. 4,806,928; U.S. Pat. No. 4,901,069; U.S. Pat. No. 5,531,592; U.S. Pat. No. 5,278,550; and U.S. Pat. No. 5,971,072.

U.S. Pat. Nos. 6,641,434 and 6,866,306 to Boyle et al., both assigned to the assignee of the present application and incorporated by reference in their entirety, disclose a wired drill pipe joint for reliably transmitting measurement data between a surface station and locations in the wellbore in high-data rates and bidirectionally. The '434 patent and the '306 patent disclose a low-loss wired pipe joint in which conductive layers reduce signal energy losses over the length of the drill string by reducing resistive losses and flux losses at each inductive coupler. The wired pipe joint is robust because the presence of gaps in the conductive layer does not prevent operation of the wired pipe joint. These and other advances in the drill string telemetry art provide opportunities for innovation where prior shortcomings of range, speed and data rate were limiting on system performance.

Regardless of the type of drill string used, drilling operations may be conducted in vertical, horizontal or deviated orientations of the wellbore. Vertical drilling refers to drilling in which the trajectory of the drill string is inclined approximately ten degrees or less. Horizontal drilling refers to drilling in which the drill string is approximately perpendicular to the ground surface. Deviated orientations of the wellbore include drilling in which the trajectory of the drill string is inclined with respect to the vertical.

Drilling at greater depths is more common recently, and drilling at greater depths typically results in exposure to higher pressures and temperatures. Downhole temperature and pressure are the two most common limiting factors for the successful utilization of advanced drilling tools. In addition, incomplete understanding of the thermal system negatively impacts formation evaluation in all phases of well construction, production and storage. While subsurface temperature and fluid pressure gradients vary regionally, both temperature and pressure generally increase with depth. Accordingly, the need to operate at higher static temperatures and pressures increases as wellbores are drilled deeper into formations for hydrocarbon and water production, thermal energy extraction, and fluid and gas storage.

DETAILED DESCRIPTION

The present disclosure generally relates to a system and a method for managing temperature in a wellbore. More specifically, the present disclosure relates to positioning thermally coated pipe joints to obtain a desired downhole temperature for the joints and/or control the effect of thermal energy in high-angle and horizontal wellbores.

Drilling fluid, commonly known as mud, is pumped from a surface pit, also known as a "mud pit," through an interior of the drill string. The drilling fluid exits at nozzles within a drill bit attached to an end of the drill string. The drilling fluid returns to the surface by traveling up a wellbore annulus which is the area between a wall of the wellbore and an exterior surface of the drill string. Drilling fluid is used in a wellbore for many purposes, such as lubrication inside the wellbore, removal of cuttings from the drill bit, removal of cuttings from the wellbore, transfer of thermal energy from the drilling system, and transfer of thermal energy from the formation, both rock and fluid, around the wellbore.

Temperature at any point in the fluid system, along the drill string, and at or within downhole hardware is controlled by many factors. These factors may be categorized according to the ability to control them and, if controllable, whether exerting control is worthwhile in view of engineering, hardware, and efficiency costs exerted to control them.

To control the temperature of the wellbore, individual or multiple joints of a drill string and/or one or more drill collars with a thermal barrier may be positioned within the wellbore. In a non-limiting embodiment, the thermally insulated drill string components may be positioned to obtain a desired and/or a predetermined downhole temperature or range of temperatures. Alternatively or additionally, the thermally insulated drill string components may be positioned to control the effect of thermal energy in high-angle and horizontal wellbores.

Figure 1:
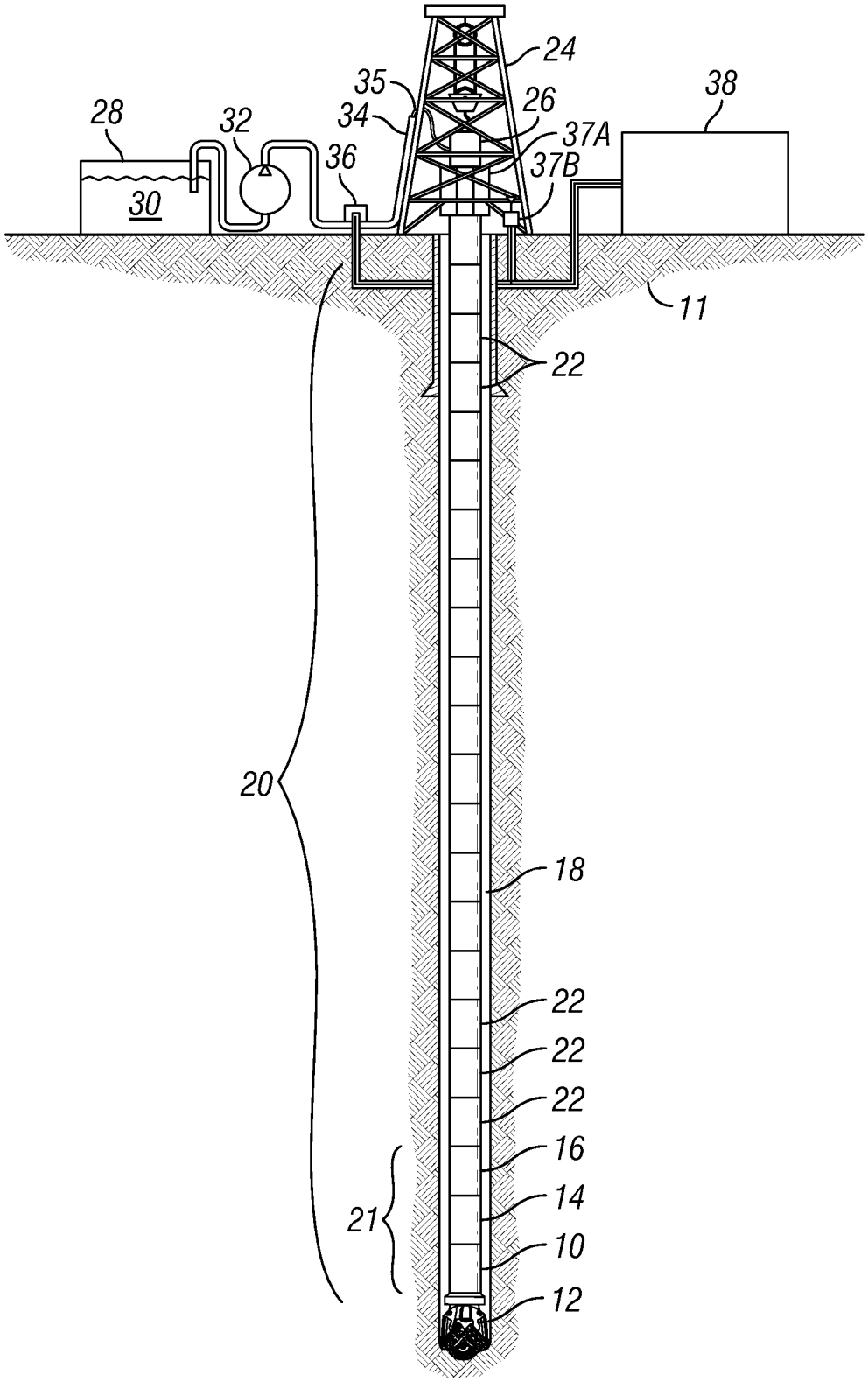
FIG. 1 illustrates a system for managing temperature in a wellbore according to one or more aspects of the present disclosure.

Referring to FIG. 1, FIG. 1 illustrates a drilling rig 24 which may suspend a drill string 20 within a wellbore 18 being drilled through subsurface earth formations 11. The drill string 20 may be assembled by coupling together end-to-end segments ("joints") 22 of drill pipe. For example, the joints 22 may have threads that enable connection to each other. The drill string 20 may have a drill bit 12 at the lower end of the drill string 20. A bottom hole assembly 21 (hereafter "the BHA 21") may be located adjacent to the drill bit 12. If the drill bit 12 is urged into the formations 11 at the bottom of the wellbore 18 and/or rotated by equipment, such as, for example, a top drive 26 located on the drilling rig 24, the drill bit 12 may extend the wellbore 18. The top drive 26 may be substituted in other embodiments by a swivel, a kelly, a kelly bushing, a rotary table and/or the like. Accordingly, the present disclosure is not limited to use with top drive drilling systems.

The lower end of the drill string 20 may have, at a selected position above and proximate to the drill bit 12, a hydraulically operated motor ("mud motor") 10 to rotate the drill bit 12 either by itself or in combination with rotation of the drill string 20 from the surface. The BHA 21 and/or the lower end of the drill string 20 may have one or more MWD instruments 14 and/or one or more LWD instruments 16.

During drilling of the wellbore 18, a pump 32 may lift drilling fluid 30 from a drilling fluid tank 28. The pump 32 may direct the drilling fluid 30 under pressure through a standpipe 34, a flexible hose 35 and/or the top drive 26 and into an interior passage (not shown separately in FIG. 1) inside the drill string 20. The drilling fluid 30 may exit the drill string 20 through nozzles (not shown separately) in the drill bit 12, thereby cooling and lubricating the drill bit 12 and lifting drill cuttings generated by the drill bit 12 to the earth's surface.

The MWD instrument 14 and/or the LWD instrument may be associated with a telemetry transmitter (not shown separately) that modulates flow of the mud 30 through the drill string 20. Modulation of mud flow may cause pressure variations in the mud 30 that may be detected at the earth's surface by a pressure transducer 36 which may be located between the pump 32 and the top drive 26. Signals from the transducer 36 which may be, for example, electrical signals and/or optical signals, may be conducted to a recording unit 38 for decoding and interpretation. The decoded signals may correspond to measurements made by one or more of the sensors (not shown) in the MWD instrument 14 and/or the LWD 16 instrument. Such mud pressure modulation telemetry may be used in conjunction with, or as backup for an electromagnetic telemetry system including wired drill pipe as described hereafter.

A wireless transceiver 37A may be disposed in the uppermost part of the drill string 20 and may be directly coupled to the top drive 26. The wireless transceiver 37A may have communication devices to wirelessly transmit data between the drill string 20 and a recording unit 38. For example, a second wireless transceiver 37B may transmit the data between the drill string 20 and the recording unit 38.

An electromagnetic transmitter (not shown separately) may be included in the LWD instrument 16 and may generate signals that are communicated along electrical conductors in wired drill pipe. For example, the joints 22 may be wired drill pipe joints which may be interconnected to form the drill string 20. The wired drill pipe may provide a signal communication conduit communicatively coupled at each end of each of the wired drill pipe joints. For example, the wired drill pipe preferably has an electrical conductor and/or an optical conductor extending at least partially within the drill pipe with inductive couplers positioned at the ends of each of the wired drill pipe joints. The wired drill pipe enables communication of the data from downhole to the recording unit 38. Examples of wired drill pipe that may be used and are described in detail in U.S. Pat. Nos. 6,641,434 and 6,866,306 to Boyle at al. and U.S. Pat. No. 7,413,021 to Madhavan et al. and U.S. Patent App. Pub. No. 2009/0166087 to Braden et al., assigned to the assignee of the present application and incorporated by reference in their entireties. Aspects described are not limited to a specific embodiment of the wired drill pipe and/or the wired drill pipe joints 22. The wired drill pipe may be any telemetry system capable of transmitting the data from downhole to the recording unit 38 and transmitting the control signals downhole from the recording unit 38 as known to one having ordinary skill in the art.

The recording unit 38 may be located at the surface adjacent to the drilling rig 24; alternatively, the recording unit 38 may be located remotely, and the data may be transmitted between the drilling site to the recording unit 38. In an embodiment, the recording unit 38 may be downhole such that the recording unit 38 may be located in the wellbore 18 and/or may be mechanically connected to the drill string 20. The recording unit 38 may be any device or component for receiving, analyzing and/or manipulating the data. The recording unit 38 may have a processor for processing the data. The recording unit 38 may receive the data and/or may transmit control signals downhole using mud pulse telemetry and/or wired drill pipe as discussed previously. Aspects described are not limited to a specific embodiment of the recording unit 38, and the drilling system 10 may have any number of terminals.

Figure 2A:
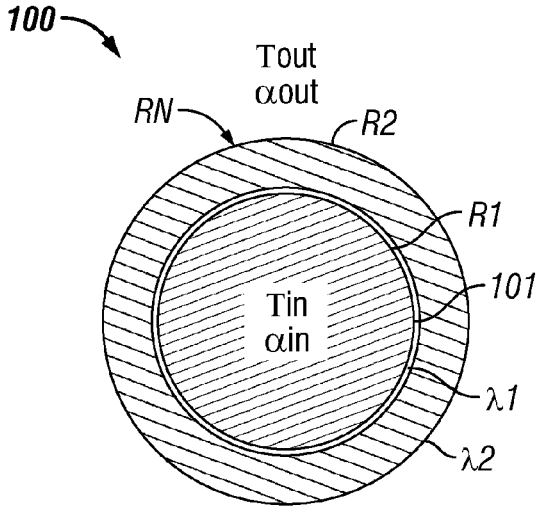
FIG. 2A illustrates a cross-sectional view of a drill pipe having a thermal barrier according to one or more aspects of the present disclosure.
Figure 2B:
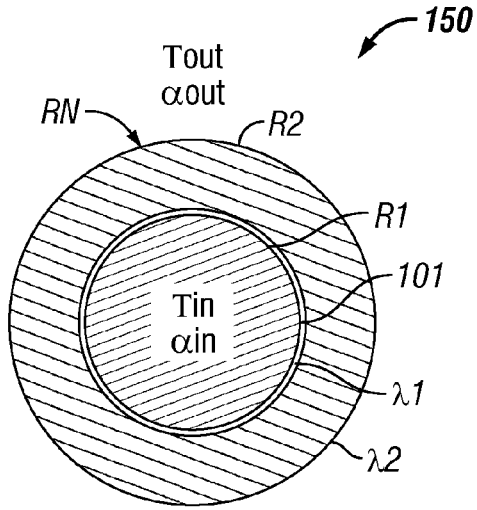
FIG. 2B illustrates a cross-sectional view of a drill collar or tool joint having a thermal barrier according to one or more aspects of the present disclosure.

FIG. 2A generally illustrates a cross-sectional view of a drill pipe 100 having a thermal barrier 101 according to one or more aspects of the present disclosure. FIG. 2B generally illustrates a cross-sectional view of a drill collar or a tool joint 150 (hereafter "the drill collar 150") having the thermal barrier 101 according to one or more aspects of the present disclosure.

The thermal barrier 101 may be positioned on an interior or an exterior of the drill pipe 100 and/or the drill collar 150. In an embodiment, the thermal barrier 101 may be a thermal coating applied to the interior surface of one or more joints of the drill pipe 100 and/or one or more drill collars 150. The thermal barrier 101 may be made of a rubber, an elastomer and/or fiberglass, for example. Specific examples of coatings which may be used as the thermal barrier 101 are FX-100 coating by Flame Seal Products, Inc.; Albi Clad 800 coating by Albi Manufacturing; and CP40XX coating by Aremco Products, Inc. (all trademarks of the corresponding entity). However, the thermal barrier 101 is not limited to a specific embodiment, and the thermal barrier 101 may be any material having a low thermal conductivity. For example, the thermal barrier 101 includes all materials applied to the drilling equipment as a bonded surface layer or an unbonded surface layer or within the material matrix, both in manufacturing and during servicing, for the purpose of reducing the thermal conductivity of that drilling equipment.

Heat flow through the drill pipe 100 and/or the drill collar 150 is a function of the thermal conductivity through each layer of the drill pipe 100 and the drill collar 150, respectively. Application of the thermal barrier 101 to the inside or the outside of the drill pipe 100 and/or the drill collars 150 may reduce heat transfer through the drill pipe 100 and/or the drill collars 150 to the drilling fluid. Cooler drilling fluid traveling to the drill bit may result in lower temperature inside and/or outside of the bottom hole assembly ("BHA"). The lower temperature may reduce strain on downhole electronics and materials, such as elastomers in a mud motor, for example.

Use of the thermal barrier 101 may be applicable in horizontal wells and/or vertical wellbores. As shown in FIGS. 2A and 2B, the thermal barrier 101 may be a coating located on the inside of the drill pipe 100 and/or the drill collar 150. Positioning the thermal barrier 101 on the inside of the drill pipe 100 may reduce abrasion experienced by the thermal barrier 101 and/or may increase the lifespan of the thermal barrier 101. The thermal barrier 101 is not limited to a specific location within the drill pipe 100 and/or the drill collars 150, and the thermal barrier 101 may be located at any location within the interior and/or the exterior of the drill pipe 100 and/or the drill collars 150.

Figure 3:
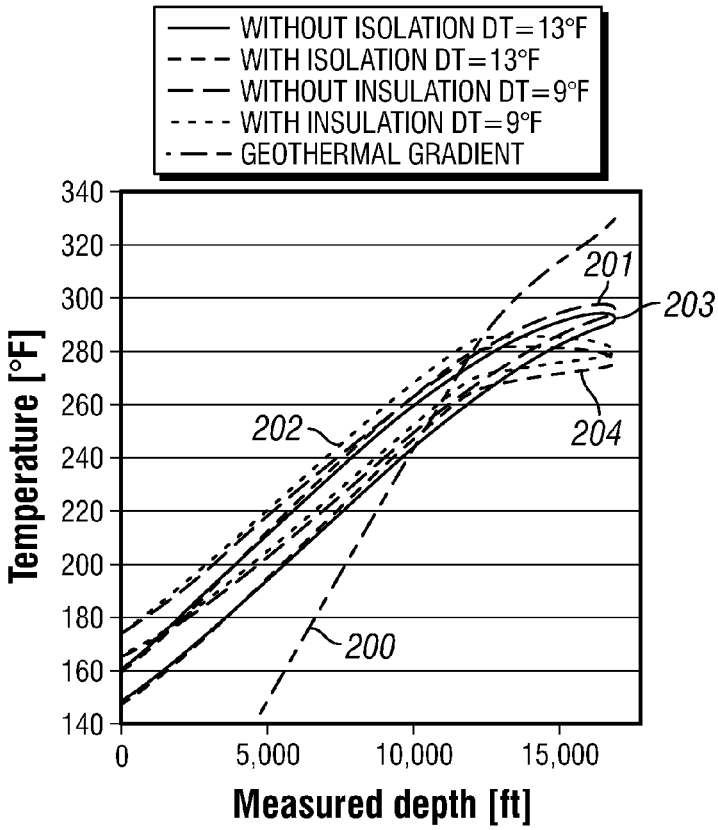
FIG. 3 illustrates an example of Earth's natural thermal gradient and an advantageous result of a thermal barrier used on one or more drill pipes or drill collars according to one or more aspects of the present disclosure.

Heat transfer through the drill pipe 100 is dependent on the thickness of the drill pipe 100 and the isolation layers of the drill pipe 100. The thickness of the drill pipe 100 and the isolation layers may be defined by the radius of the isolation layers, namely $R_1, R_2, \ldots, R_n$. The thermal conductivity of the isolation layers are $8_1, 8_2, \ldots, 8_n$. The drilling fluid within the drill pipe 100 has a temperature of $T_{in}$, and the heat transfer coefficient from the drilling fluid to the wall of the wellbore is $\forall_{in}$. The temperature and the heat transfer coefficient for the drilling fluid located outside of the drill pipe 100 are $T_{out}$ and $\forall_{out}$, respectively. By using Fourier's law of conduction and Newton's law of cooling, the following equation applies to steady state heat transfer:

$$dQ/dt=U\times A(T_{in}-T_{out})$$

where $1/U=R_1\times[1/(\forall_{in}\times R_1)+1/(\forall_{out}\times R_n)+3\ \ln(R_i+1/R_i)/8_i]$ dQ/dt=transferred heat per unit time L=length of pipe $A=2\times B\times L\times R_1$ U is the overall heat transfer coefficient Applying the principle of heat transfer consecutively to each joint of the drill pipe 100, which typically has a length of approximately thirty feet each, may result in a desired downhole temperature. A temperature decrease may shock the formation with thermal contraction, and thermal contraction may endanger the wellbore by causing formation break-outs which may increase the probability of a stuck pipe event. The temperature may be lowered to a reasonable operating temperature for the downhole electronics as shown in FIGS. 3-5 which depict the modeled results of using a 15 mm coating with a thermal conductivity of 0.872 W/mK with variable total length and placement of insulative material.

The modeling is based on an generally L-shaped wellbore that may be drilled vertically to a depth of 12,000 feet and a lateral section having a length of 5,000 feet extending to 17,000 feet measured depth. The earth's natural thermal gradient is assumed to be a static earth temperature of 280° F. at a depth of 12,000 feet and 10° F./1000 feet drilling-induced temperature across the lateral section of the wellbore. The maximum temperature is 330° F. at the total depth of the well, namely 17,000 feet. As shown in FIG. 3, a first thermal gradient in the geothermal gradient curve 200 depicts the earth's natural thermal gradient to a depth of 12,000 feet. The wellbore is drilled horizontally from a depth of 12,001 feet to a depth of 17,000 feet where the geothermal gradient curve 200 represents the temperature increase caused by drilling-induced friction. A second thermal gradient in the geothermal gradient curve 200 represents the temperature increase caused by drilling-induced friction.

The curves 201, 203 represent drilling without the thermal barrier 101. The curves 202, 204 demonstrate the effect of using the thermal barrier 101 from a depth of 12,000 feet to a depth of 17,000 feet. Less than one-third of the drill string coated results in a reduction in temperature of approximately 20° F. Moreover, the starting temperature of drilling with the thermal barrier 101 is 149° F., and the starting temperature of drilling without the thermal barrier 101 is 163° F. Managing temperature at the surface may have a significant effect on the downhole temperature at the drill bit.

Figure 4:
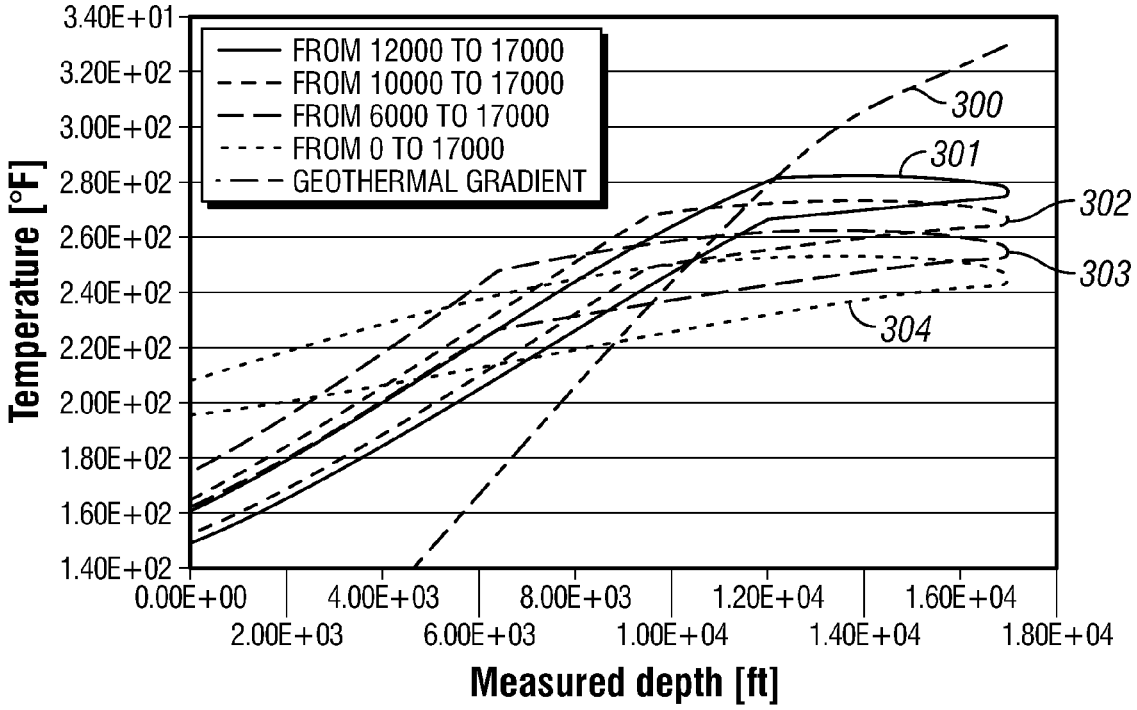
FIG. 4 illustrates Earth's static temperature gradient and an advantageous result of a thermal barrier in a drill string or drill collar according to one or more aspects of the present disclosure.

FIG. 4 generally illustrates a geothermal gradient curve 300 which represents the earth's static temperature to a depth of 12,000 feet and drilling-induced frictional temperature gradient from a depth of 12,001 feet to a depth of 17,000 feet. The first curve 301 generally illustrates the effect of insulating the drill string with the thermal barrier 101 from a depth of 12,000 feet to a depth of 17,000 feet. The second curve 302 generally illustrates the effect of insulating the drill string with the thermal barrier 101 from a depth of 10,000 feet to a depth of 17,000 feet. The third curve 303 generally illustrates the effect of insulating the drill string with the thermal barrier 101 from a depth of 6,000 feet to a depth of 17,000 feet. The fourth curve 304 generally illustrates the effect of insulating the drill string with the thermal barrier 101 from the surface to a depth of 17,000 feet.

FIG. 4 demonstrates that each additional increment of drill string having the thermal barrier 101 decreases the temperature approximately 10° F. Delivering drilling fluid having a cooler temperature to the drill bit results in increased heat exchange for the drilling fluid returning to the surface in the annulus; however, as indicated in the model, the overall annular temperature will also be lower. This model reflects a fixed offset for cooling of the drilling fluid at the surface. In practice, surface cooling may be treated as a separate sub-system affected by increased surface area of the mud pits, larger volume of drilling fluid in the system, or coolers which reduce the heat at the surface.

Combining wired drill pipe with placement of the thermal barrier 101 in the drill pipe 100 and/or the drill collars 150 may enable management of downhole temperature at the drill bit. The wired drill pipe may convey temperature measurements obtained downhole in sensors or tools, such as in a BHA, and may convey measurements, such as temperature measurements, obtained at each repeater. A repeater is typically located approximately every 1,500 feet, and each repeater may be associated with one or more sensors, such as a temperature sensor. For example, one or more of the sensors may be incorporated into the repeater with which the sensor is associated. The temperature at a repeater may be a temperature of the drill pipe 100, a temperature of the drilling fluid in the drill pipe 100, and/or a temperature of the drilling fluid in the annulus between the drill pipe 100 and a wall of the wellbore. The temperature model may be adjusted based on these measurements while "tripping in" the wellbore and changing the placement of the drill pipe 100 and/or the drill collars 150 having the thermal barrier 101.

The recording unit 38 may adjust the temperature model. If the recording unit 38 is located at the surface, the sensors in the wellbore may be communicatively connected to the recording unit 38 by the wired drill pipe. The wired drill pipe may convey real-time temperature measurements from the sensors to the recording unit 38, and the recording unit 38 may use the real-time temperature measurements to automatically adjust the temperature model.

A temperature model for a local wellbore may be generated using assumptions from remote wellbores located tens of miles or even hundreds of miles away from the local wellbore. However, monitoring temperature at multiple depths may enable the temperature model to be adjusted to conform to changes in downhole temperature caused by drilling. The temperature model may be based on drilling parameters in addition to the positioning of the thermal barrier 101. For example, drilling parameters, such as increased weight-on-bit, may increase temperatures caused by frictional forces at the drill bit and/or may increase frictional force at any inflection point in the drill string.

Figure 5A:
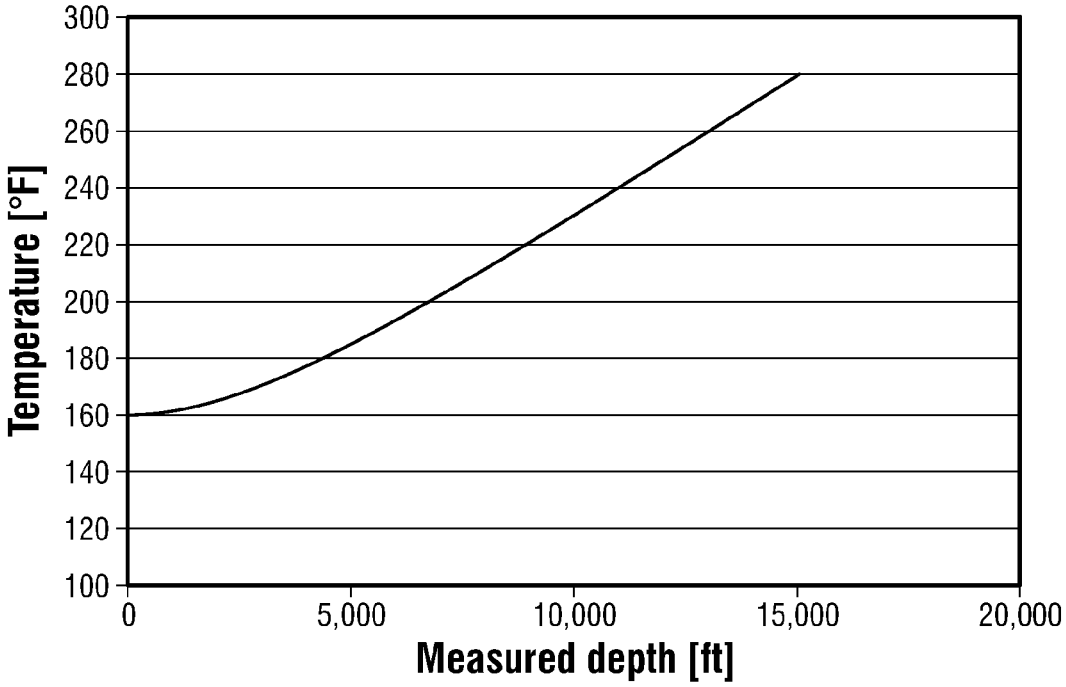
FIG. 5A illustrates a temperature profile of a wellbore at a first flow rate according to one or more aspects of the present disclosure.
Figure 5B:
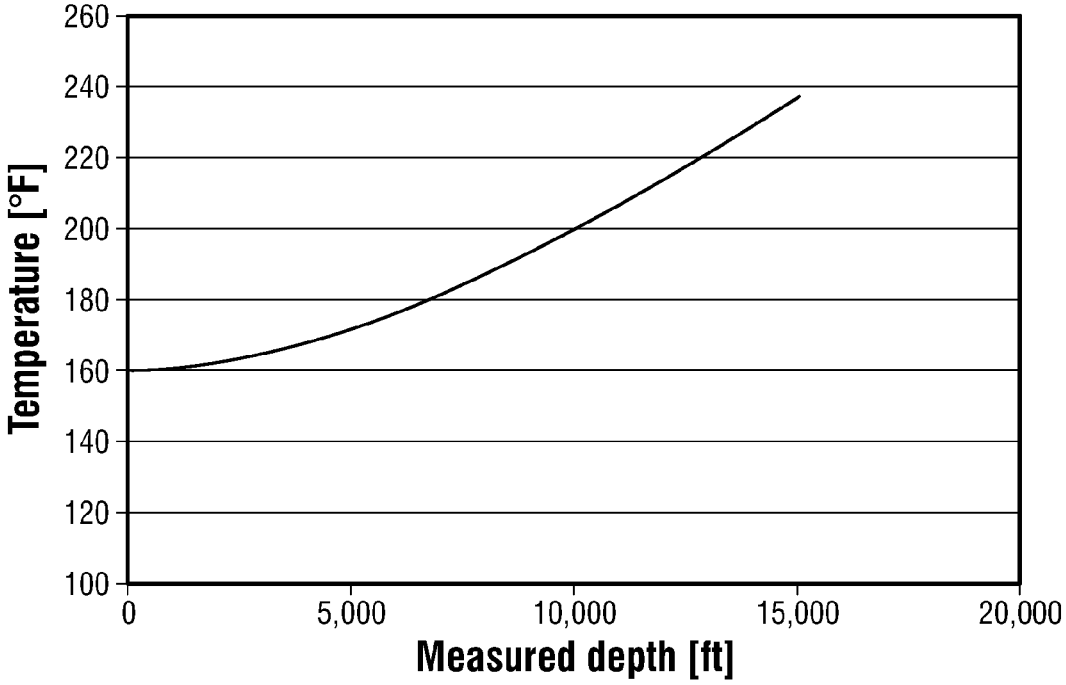
FIG. 5B illustrates a temperature profile of a wellbore at a second flow rate that is higher than the first flow rate according to one or more aspects of the present disclosure.

Thermal cooling may be controlled by adjusting flow rates of the drilling fluid within the operating limits of the modulator flow rates of the Measurement While Drilling (MWD) tool. Using wired drill pipe for communication may expand the flow rate range relative to the flow rate range of drilling systems which use mud pulse telemetry. FIG. 5A generally illustrates a graph of temperature along a vertical wellbore as a function of depth at 100 gpm drilling fluid flow rate. FIG. 5B generally illustrates a graph of temperature along the vertical wellbore as a function of depth at 300 gpm drilling fluid flow rate. FIGS. 5A and 5B demonstrate that changing the flow rate from 100 gpm to 300 gpm causes a change in the downhole temperature which is larger than 40° F.

The temperature in the heel of a horizontal wellbore may be approximately 40° F. lower than the temperature in the toe of the wellbore for a temperature difference of approximately 15% between the heel and the toe of the horizontal wellbore. For horizontal wellbores drilled upward from the toe, the heel is the deepest point in the horizontal wellbore. Accordingly, a temperature difference of 15% or more is independent of factors resulting from drilling to maximum depth, such as formation static temperature and heat generated at the drill bit.

The additional temperature in the lateral section of a wellbore is a result of drilling-induced friction and dynamics of fluid flow increasing the temperature of the drill pipe and the formation. Horizontal wellbores typically range in length from 3,000 feet to over 10,000 feet. The horizontal orientation may result in gravitational forces which may increase drag from approximately zero, as experienced in a vertical wellbore, to the full weight of the drill string moving in contact with the wellbore to create "drag."

Figure 6:
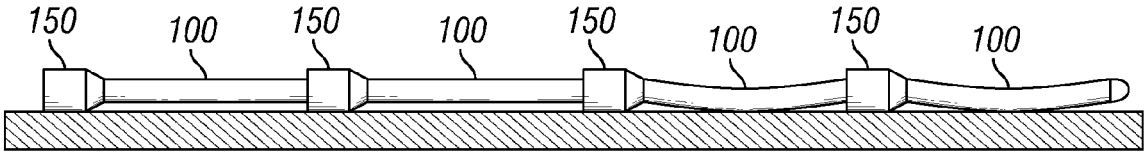
FIG. 6 illustrates a horizontal section of a drill string engaging a wall of a wellbore according to one or more aspects of the present disclosure.
Figure 7:
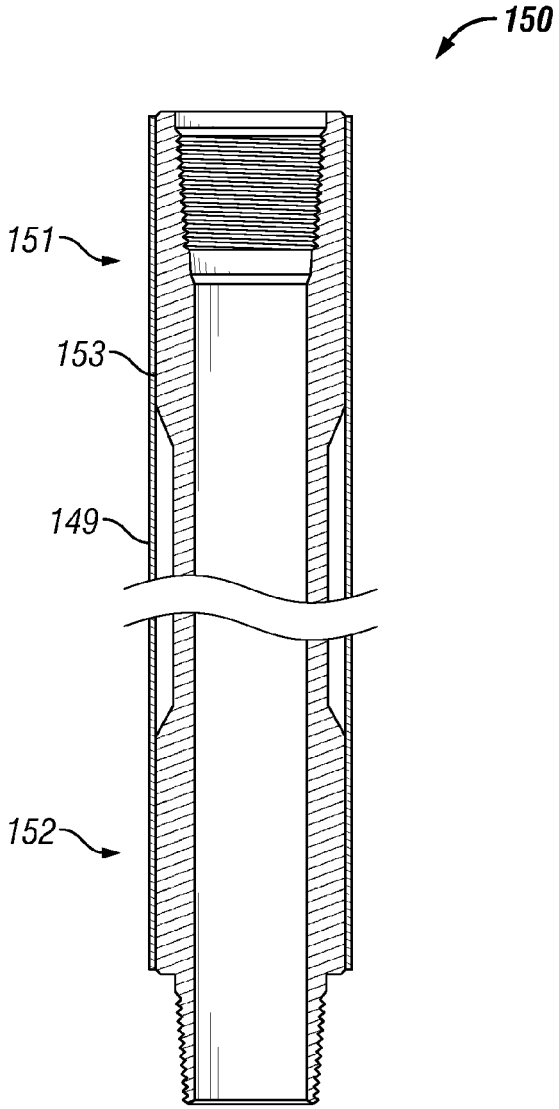
FIG. 7 illustrates an example of a joint of drill pipe according to one or more aspects of the present disclosure.

FIGS. 6 and 7 indicate areas of the drill string likely to create drag and/or increase drill string mass. The greater surface area along the lateral section of the wellbore provides more opportunity for heat exchange through thermal conduction to the drilling fluid pumped down the drill pipe. The thermal barrier 101 and/or altering drilling parameters, such as RPM and flow rates, may mitigate the increased opportunity for heat exchange. The frictional forces at the drill bit are the greatest source of temperature increases; however, increased mass and outside diameter 149 of the drill collars 150 located approximately every thirty feet has a much larger effect on drilling-induced friction.

As shown in FIG. 6, the drill pipe 100 and/or the drill collar 150 may experience drag between each joint which depends on the stiffness and the curvature of the drill string. In addition, the drag between each joint depends on the difference between the radius of operation of the drill pipe 100 and the "standoff," namely the distance between the external surface of the drill collar 150 and the wall of the wellbore hole. Each drill collar 150 in a joint contacts the bottom of the lateral section of the wellbore. Increasing the rotation of the drill string increases the frictional heat generated in the lateral section. FIG. 7 illustrates an increased mass around the box 151 and the pin 152 of the drill collar 150 in addition to a smaller internal diameter 153 in the tube in the middle of the drill collar 150.

A reduction in RPM may decrease the total rate of penetration (ROP) and, as a result, increase total drilling cost. ROP, therefore, should be maintained during drilling. Positioning a straight motor proximate to the bottom of the drill string may maintain RPM at the drill bit and/or reduce RPM of the drill string in the lateral section of the wellbore. More specifically, hydraulic drilling fluid flow may turn the straight motor to supplement the rotation provided by the drill string rotation performed at the surface.

The straight motor proximate to the drill bit may be positioned above or below the downhole sensor system in the logging while drilling (LWD) and MWD tools. A position above the LWD tools and the MWD tools increases the RPM of these tools and may be appropriate if the RPM is approximately 100% hydraulically controlled. Such a position may eliminate nearly all frictional forces along the lateral section of the wellbore; however, the RPM may be significantly lower than combining surface rotation with the straight motor. A position below the LWD tools and the MWD tools may increase the ROP at the drill bit while allowing the LWD tools and the MWD tools to rotate at the same rates as the surface rotation of the drill string. Varying the drilling fluid flow through the drill bit may substantially impact downhole temperatures through alteration of drilling parameters as previously discussed with respect to FIGS. 5A and 5B.

In summary, the thermal barrier 101 may be positioned within the drill pipe 100 and/or the drill collars 150 to obtain a desired downhole temperature and/or to control the effect of thermal energy in high-angle and horizontal wellbores. Downhole measurements, such as real-time measurements and/or recorded measurements, may be used to update models, such as steady state models and/or dynamic models. The downhole measurements may validate the static temperature gradient and may provide information about the thermal characteristics of the one or more formations in which the wellbore is located.

In one embodiment, a method for managing temperature in a wellbore is described, the method comprising determining at least one desired temperature for at least one depth of the wellbore during drilling, and positioning at least one drill string component having a thermal barrier within a drill string wherein at least one position of the at least one drill string component having the thermal barrier is determined based on the at least one desired temperature.

In another embodiment, the method may further comprise obtaining at least one temperature measurement along the drill string using at least one sensor located along the drill string wherein the at least one position of the at least one drill string component having the thermal barrier is determined based on the at least one temperature measurement and the at least one desired temperature.

In another embodiment, the method may further comprise obtaining at least one temperature measurement along the drill string using the at least one sensor located along the drill string wherein the position in the drill string of one of the at least one drill string components having the thermal barrier is changed to a new position in the drill string based on the at least one temperature measurement.

In another embodiment, the method may further comprise obtaining at least one temperature measurement along the drill string using at least one sensor located along the drill string wherein one of the drill string components having the thermal barrier is removed from the drill string based on the at least one temperature measurement.

In another embodiment, the method may further comprise obtaining at least one temperature measurement along the drill string using at least one sensor located along the drill string wherein one of the drill string components having the thermal barrier is added to the drill string based on the at least one temperature measurement.

In another embodiment, a system for managing temperature in a wellbore is described, the system comprising: a drill string at least partially formed by wired drill pipe, at least one sensor distributed along the drill string which are configured to obtain at least one temperature measurement transmitted by the wired drill pipe wherein a temperature model generated before initiation of drilling is adjusted based on the at least one temperature measurement, and a drill string component having a thermal barrier wherein a position of the drill string component is determined based on the temperature model.

In another embodiment, the system may further comprise at least one repeater which amplifies signals transmitted by the wired drill pipe wherein at least one of the sensors is incorporated into one of the repeaters.

In another embodiment, the system may further comprise an arrangement wherein thermal characteristics of a formation adjacent to the wellbore are determined based on the at least one temperature measurement and further wherein the temperature model is adjusted based on the thermal characteristic of the formation.

In another embodiment, the system is configured wherein the drill string component having the thermal barrier is a drill collar having an interior in which the thermal barrier is located.

In another embodiment, the system is configured wherein the drill string component having the thermal barrier is a drill collar having an exterior on which the thermal barrier is located.

In a still further embodiment, the system is configured wherein the drill string component having the thermal barrier is a drill pipe section having an interior in which the thermal barrier is located.

In another embodiment, the system is configured wherein the drill string component having the thermal barrier is a drill pipe section having an exterior on which the thermal barrier is located.

In another embodiment, the system further comprises a processor located at the surface wherein the processor automatically adjusts the temperature model in response to receipt of the temperature measurements.

In another embodiment, the system is further configured with a straight motor proximate to the bottom of the drill string wherein rotations per minute of the straight rotor are determined based on the temperature model and the temperature measurements.

In another embodiment a method for managing temperature in a wellbore is disclosed, the method comprising: positioning at least one thermally insulated drill string component within a drill string; transmitting at least one temperature measurement obtained by at least one sensor located along the drill string wherein wired drill pipe which forms at least a portion of the drill string transmits the at least one temperature measurement; and adjusting a drilling parameter based on the at least one temperature measurement.

In another embodiment, the method is performed wherein drilling fluid flow rate is the drilling parameter.

In another embodiment, the method is performed wherein a property of drilling fluid used by the drill string is the drilling parameter.

In another embodiment, the method is performed wherein rotations per minute of a straight motor proximate to a bottom of the drill string is the drilling parameter.

In another embodiment, the method is performed wherein a position in the drill string of one of the thermally insulated drill string components is the drilling parameter and further wherein adjusting the drilling parameter changes the position in the drill string of the thermally insulated drill string component.

In another embodiment, the method may further comprise drilling a lateral section of the wellbore, wherein the temperature measurements indicate drag caused by drilling the lateral section.

Various changes and modifications to the presently preferred embodiments described herein will be apparent to those having ordinary skill in the art. Such changes and modifications may be made without departing from the spirit and scope of the present disclosure and without diminishing its attendant advantages. It is, therefore, intended that such changes and modifications be covered by the claims.

What is claimed is:

1. A method for managing temperature in a wellbore, the method comprising:

determining at least one desired temperature for at least one depth of the wellbore during drilling; and positioning at least one drill string component having a thermal barrier within a drill string wherein at least one position of the at least one drill string component having the thermal barrier is determined based on the at least one desired temperature.

2. The method of claim 1 further comprising:

obtaining at least one temperature measurement along the drill string using at least one sensor located along the drill string wherein the at least one position of the at least one drill string component having the thermal barrier is determined based on the at least one temperature measurement and the at least one desired temperature.

3. The method of claim 1, further comprising:

obtaining at least one temperature measurement along the drill string using the at least one sensor located along the drill string wherein the position in the drill string of one of the at least one drill string components having the thermal barrier is changed to a new position in the drill string based on the at least one temperature measurement.

4. The method of claim 1, further comprising:

the drill string having one or more additional drill string components having the thermal barrier and obtaining at least one temperature measurement along the drill string using at least one sensor located along the drill string wherein one of the drill string components having the thermal barrier is removed from the drill string based on the at least one temperature measurement.

5. The method of claim 1, further comprising:

obtaining at least one temperature measurement along the drill string using at least one sensor located along the drill string wherein one or more additional drill string components having the thermal barrier is added to the drill string based on the at least one temperature measurement.

6. A system for managing temperature in a wellbore, the system comprising:

a drill string at least partially formed by wired drill pipe;

at least one sensor distributed along the drill string which are configured to obtain at least one temperature measurement transmitted by the wired drill pipe wherein a temperature model generated before initiation of drilling is adjusted based on the at least one temperature measurement; and a drill string component having a thermal barrier wherein a position of the drill string component is determined based on the temperature model.

7. The system of claim 6, further comprising:

at least one repeater which amplifies signals transmitted by the wired drill pipe wherein at least one of the sensors is incorporated into one of the repeaters.

8. The system of claim 6, wherein thermal characteristics of a formation adjacent to the wellbore are determined based on the at least one temperature measurement and further wherein the temperature model is adjusted based on the thermal characteristic of the formation.

9. The system of claim 6, wherein the drill string component having the thermal barrier is a drill collar having an interior in which the thermal barrier is located.

10. The system of claim 6, wherein the drill string component having the thermal barrier is a drill collar having an exterior on which the thermal barrier is located.

11. The system of claim 6, wherein the drill string component having the thermal barrier is a drill pipe section having an interior in which the thermal barrier is located.

12. The system of claim 6, wherein the drill string component having the thermal barrier is a drill pipe section having an exterior on which the thermal barrier is located.

13. The system of claim 6, further comprising:

a processor located at the surface wherein the processor automatically adjusts the temperature model in response to receipt of the temperature measurements.

14. The system of claim 6 further comprising:

a straight motor proximate to the bottom of the drill string wherein rotations per minute of the straight motor are determined based on the temperature model and the temperature measurements.

15. A method for managing temperature in a wellbore, the method comprising:

positioning at least one thermally insulated drill string component within a drill string;

transmitting at least one temperature measurement obtained by at least one sensor located along the drill string wherein wired drill pipe which forms at least a portion of the drill string transmits the at least one temperature measurement; and adjusting a drilling parameter based on the at least one temperature measurement.

16. The method of claim 15, wherein drilling fluid flow rate is the drilling parameter.

17. The method of claim 15, wherein a property of drilling fluid used by the drill string is the drilling parameter.

18. The method of claim 15, wherein rotations per minute of a straight motor proximate to a bottom of the drill string is the drilling parameter.

19. The method of claim 15, wherein a position in the drill string of one of the thermally insulated drill string components is the drilling parameter and further wherein adjusting the drilling parameter changes the position in the drill string of the thermally insulated drill string component.

20. The method of claim 15, further comprising:

drilling a lateral section of the wellbore, wherein the temperature measurements indicate drag caused by drilling the lateral section.

* * * * *